US005101986A

United States Patent [19]

Holztrager

[11] Patent Number: 5,101,986

[45] Date of Patent: Apr. 7, 1992

[54] MERCHANDISE DISPLAY ASSEMBLY

[76] Inventor: William J. Holztrager, P.O. Box AJ, Chilhowie, Va. 24319

[21] Appl. No.: 658,015

[22] Filed: Feb. 20, 1991

[51] Int. Cl.[5] ..... A47F 7/00

[52] U.S. Cl. ..... 211/13; 211/94

[58] Field of Search ..... 211/13, 87, 88, 94; 248/902

[56] References Cited

U.S. PATENT DOCUMENTS

| | | | |
|---|---|---|---|
| 3,425,568 | 2/1969 | Albright | 211/87 |
| 3,698,565 | 10/1972 | Weber | 211/87 |
| 3,857,482 | 12/1974 | Shelton | 211/13 X |
| 4,204,602 | 5/1980 | Dunchock | 211/13 |
| 4,607,753 | 8/1986 | Radek | 211/87 |
| 4,632,260 | 12/1986 | Hart et al. | 211/87 X |
| 4,694,965 | 9/1987 | Parnell | 211/87 |
| 4,750,624 | 6/1988 | Baron | 211/87 |

FOREIGN PATENT DOCUMENTS

| | | | |
|---|---|---|---|
| 2712213 | 9/1978 | Fed. Rep. of Germany | 211/88 |
| 3705282 | 9/1987 | Fed. Rep. of Germany | 211/87 |
| 0082777 | 11/1953 | Norway | 211/87 |
| 2189692 | 11/1987 | United Kingdom | 211/87 |

*Primary Examiner*—Alvin C. Chin-Shue
*Assistant Examiner*—Sarah A. Lechok
*Attorney, Agent, or Firm*—Shlesinger, Arkwright & Garvey

[57] ABSTRACT

A merchandise display assembly which comprises a plurality of like, profile units which are interengaged vertically to provide an assembly of the desired height. Each profile unit includes a vertical wall portion and an angular merchandise supporting portion which extends outwardly and downwardly beyond the lower edge of the vertical wall portion. A vertical flange extends upwardly from the upper edge of the vertical wall portion, which flange is offset from the plane of the vertical wall portion, to form a longitudinal groove between the profile unit and a vertical support member to which it is secured, for receiving the lower edge of a profile unit connected thereto. The point of connection between adjacent profile units is hidden from view thereby giving the appearance of an integral assembly.

17 Claims, 2 Drawing Sheets

MERCHANDISE DISPLAY ASSEMBLY

This invention is a merchandise display assembly comprising a plurality of profile units which are adapted to be interengaged to provide a merchandise display assembly of any desired height which is adapted to be wall mounted, floor mounted, or incorporated in a counter display.

BACKGROUND OF THE INVENTION

For many years, it has been conventional practice for stores to display merchandise such as jewelry, eyeglasses and watches in display units which comprise a plurality of vertically arranged shelves of varying height and width, which units are mounted on a wall or incorporated in floor mounted or counter mounted display cases. Display units of this type are illustrated in U.S. Pat. No. 4,204,602, issued May 27, 1980 and U.S. Pat. No. 4,609,975, issued Sept. 2, 1986.

In view of the widely varying requirements of merchandising outlets, dictated by the space available for such displays, it is necessary that the display units be made in many different sizes to accommodate the needs of the merchant.

Attempts have been made to provide a merchandise display assembly wherein the height and width of the display assembly is varied by means of display trays which are vertically and laterally interengaged with each other. An example of such an arrangement is disclosed in U.S. Pat. No. 3,857,482, issued Dec. 31, 1974.

Although the use of interengaged units for enlarging the display assembly does serve the purpose of enabling the display to be selectively constructed to the desired size, it is not aesthetically appealing since it is evident upon inspection that the assembly is constructed of a number of units which are connected together and does not have the more pleasing integral appearance of a monolithic structure.

SUMMARY OF THE INVENTION

The present invention is a display assembly for use in retail stores or the like to display merchandise to potential customers, which assembly comprises a number of like profile units of the desired length which are vertically connected together to provide a display assembly of the required height and width.

The profile units of the present invention are interengaged vertically to provide a display assembly of the desired height, which assembly has the appearance of an integral structure by virtue of the arrangement of parts comprising the units.

The units are preferably of extruded plastic construction and comprise a vertical support portion and an angular merchandise support portion extending outwardly and downwardly from the vertical portion, the angular support portion extending below the lower edge of the vertical wall portion.

The vertical support portion of each profile unit is secured to a vertical support member. A vertical flange extends upwardly from the upper edge of the vertical wall portion in offset, parallel relation to the plane of the wall portion, thereby forming a longitudinal groove between the flange and vertical support member which is adapted to receive the lower end of a second profile unit which is interengaged therewith.

By virtue of the fact that the angular portion of the display unit extends downwardly to a point below the lower edge of the vertical wall portion, the point of connection between adjacent profiles is hidden from view, thereby providing a display assembly which has the appearance of an integrally formed, monolithic structure.

DETAILED DESCRIPTION OF THE INVENTION

Figure 1:
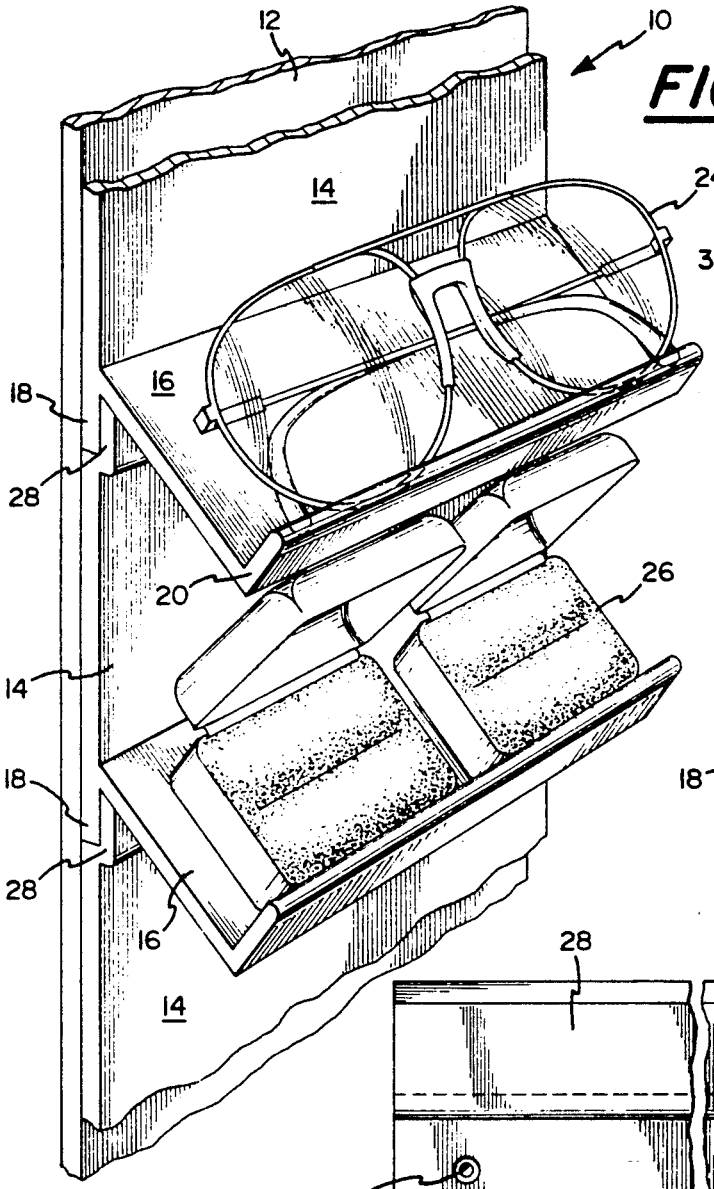
FIG. 1 is a perspective view of the merchandise display assembly of the present invention.

The merchandise display assembly of the present invention comprises a plurality of display or profile units generally designated 10 which are interengaged vertically and secured to a vertical support member 12, as shown to advantage in FIG. 1.

Each profile unit 10 is preferably of unitary extruded construction such as a polyvinylchloride extrusion. Profile unit 10 comprises a vertical wall portion 14 and an angular wall portion 16 which extends downwardly and outwardly at approximately a 45 degree angle from the lower part of vertical wall portion 14, thereby forming a vertical wall portion extension 18 of predetermined length beyond angular wall portion 16.

Figure 5:
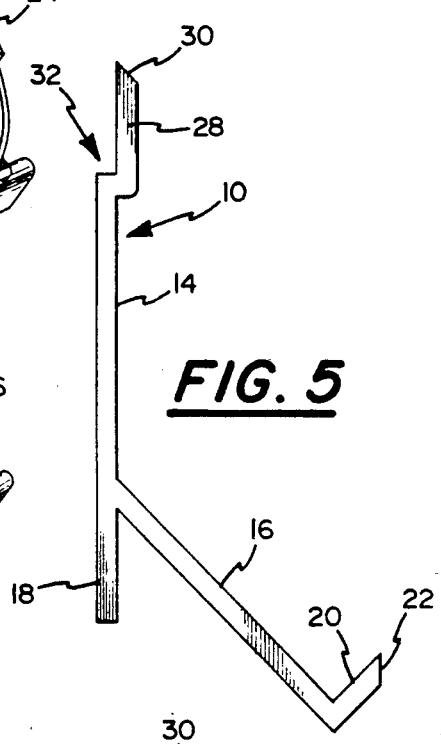
FIG. 5 is an end elevational view of the profile unit.
Figure 4:
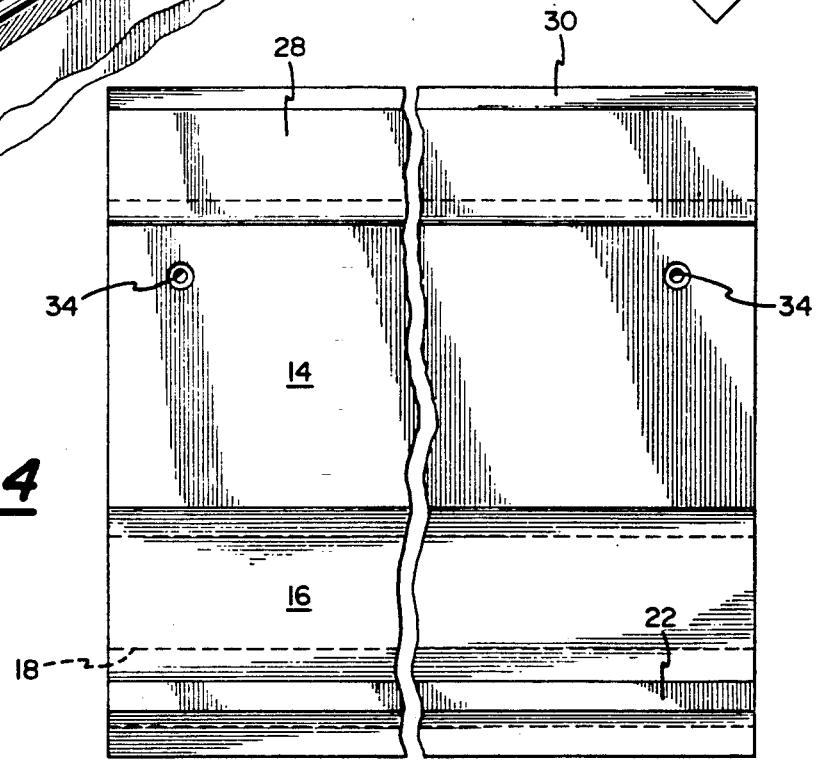
FIG. 4 is a fragmentary front elevational view of a profile unit forming a part of the present assembly.

As shown in FIG. 5, angular wall portion 16 extends downwardly to a point substantially below the lower edge of extension 18, and is provided with a foot 20 which is directed upwardly from angular wall portion 16 at approximately a 90 degree angle, and terminates in a beveled end 22.

As shown in FIG. 1, angular wall portion 16 and foot 20 are coextensive with the length of vertical wall portion 14 and are adapted to receive eyeglasses 24, jewelry boxes 26 or other merchandise placed thereon for display purposes.

Figure 3:
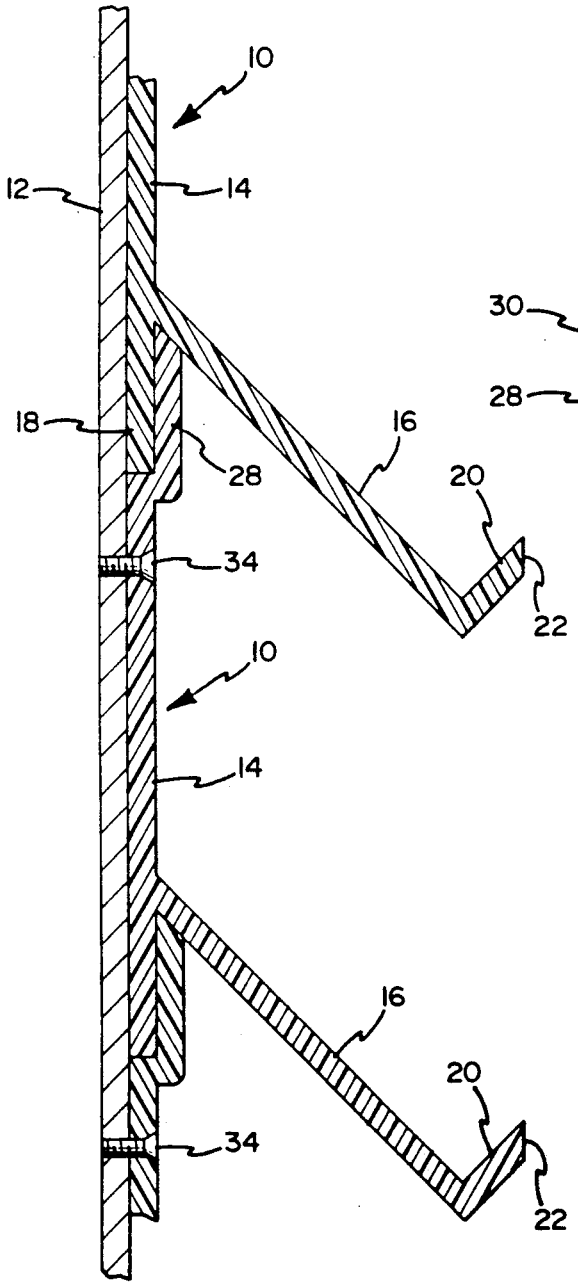
FIG. 3 is a sectional view taken along the line 3—3 of FIG. 2, looking in the direction of the arrows.
Figure 2:
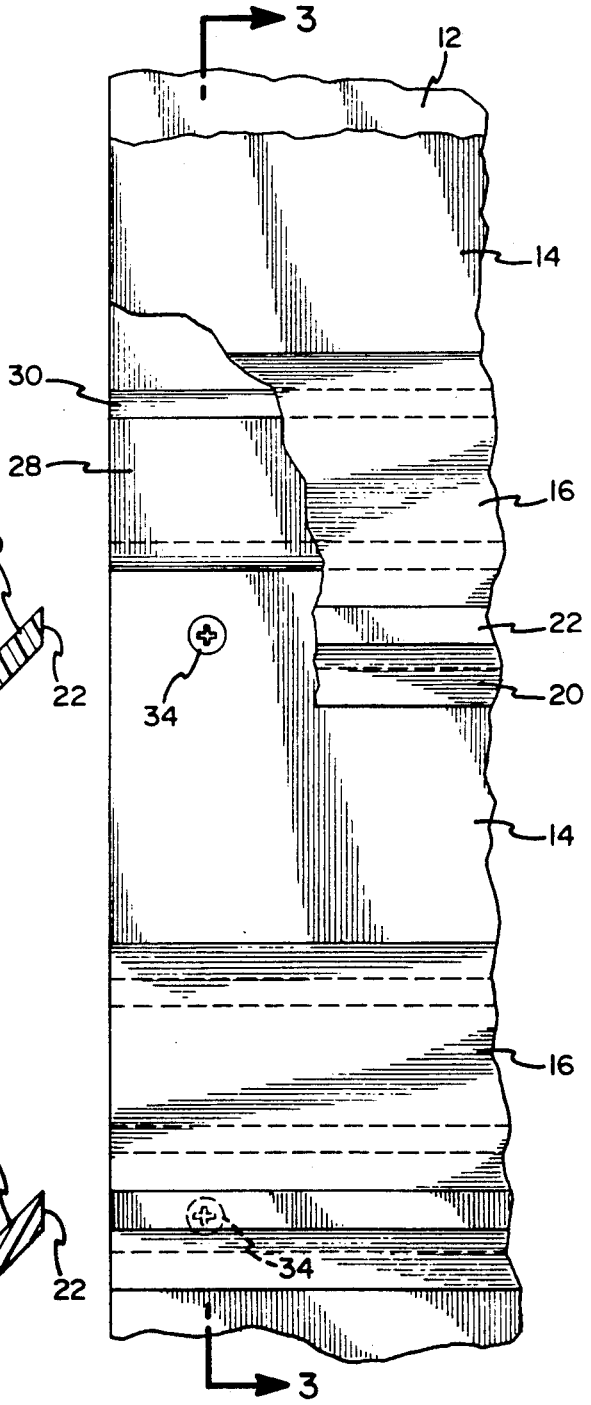
FIG. 2 is a front elevational view thereof, portions thereof being broken away to disclose details of construction.

Referring to FIGS. 1, 3 and 5, the upper end of vertical wall portion 14 is provided with a vertical upstanding flange 28 which is offset forwardly from the vertical plane of vertical wall portion 14 and is substantially the same length as extension 18 of vertical wall portion 14. The upper extremity of flange 28 is beveled at a 45 degree angle, as indicated at 30, which is substantially equal to the angle at which angular wall portion 16 extends downwardly from vertical wall portion 14, for reasons which will be hereinafter more fully set out.

The offset flange 28 thereby provides an elongated groove or socket 32 between flange 28 and vertical support member 12, as shown to advantage in FIG. 3, the width of which is substantially equal to the width of extension 18 of the profile unit. Although extension 18 and flange 28 may be of any desired length, it is preferable that they are long enough so that groove 32 thereby formed between flange 28 and vertical support member 12 is sufficiently deep that a substantial portion of the lower edge of extension 18 will fit therein when a plurality of profile units 10 are assembled together. A groove of 1 inch has been found to produce optimum results.

It will further be noted from a consideration of FIGS. 1 and 3 that, in the assembled position, beveled surface 30 of flange 28 lies in supporting engagement with angular wall portion 16 of profile unit 10 to lend greater rigidity thereto.

Fixed engagement of profiles units 10 with vertical support member 12 is effected by one or more fasteners, such as screws 34 which extend through vertical wall portion 18 of profile unit 10 into vertical support member 12.

In assembly of the present invention, vertical support member 12 may be wall mounted, floor mounted or incorporated in a display case adapted to be mounted on a counter of a store or the like. The lowermost profile unit is then secured to vertical support member 12 by fasteners 34. A second profile unit 10 is next placed in position by inserting extension 18 of the profile unit into the longitudinal groove or socket 32 formed between flange 30 of the lower profile unit and the vertical support member 12, to hold the upper profile unit in position. When extension 18 is fully inserted into socket 32, beveled surface 30 of the lower profile unit lies in flush supporting engagement with angular portion 16 of the upper unit, as shown in FIGS. 1 and 3. A number of profile units 10 are assembled vertically until the desired height is reached, at which time merchandise such as eyeglasses 24 and jewelry boxes 26 may be placed on angular portion 16 of the respective profile units for display purposes.

It will be noted from a consideration of the figures of the drawings that, by virtue of the structural arrangement of the profile unit, the point of connection between superimposed profile units, as well as fasteners 34, are hidden from view and therefore the resultant assembly has the appearance of an integral structure as opposed to a series of parts which have been joined together for purposes of enlargement.

The profile units of the present invention may be of varying lengths so that, in conjunction with the ease of assembly thereof, display assemblies of a wide range of heights and widths may be provided, the parts thereof being readily assembled on the site or preassembled, in the case of wall or floor mounted units, thereby providing a finished assembly of economic construction which may be readily assembled for use in a short period of time by unskilled workmen.

While there has been herein described and claimed the presently preferred form of this invention, it is to be understood that such has been done for purposes of illustration only, and various changes may be made therein within the scope of the appended claims.

I claim:

1. A merchandise display assembly for engagement with a vertical support member, said assembly including:

a) a plurality of like merchandise profile units;

b) each of said profile units having a vertical portion in flush engagement with said vertical support member and an angular portion comprising a rectilinear main supporting part extending downwardly and outwardly from the vertical portion, on which merchandise is placed for display;

c) the upper end of the vertical portion of each of said profile units being provided with an upwardly extending flange which is offset from the plane of the vertical portion of the profile unit, thereby forming a longitudinal groove between said upwardly extending flange and the vertical support member, for the reception of the lower edge of the vertical portion of an adjacent profile unit; and, d) means for securing the vertical portion of each of said profile units to said vertical support member.

2. The merchandise display assembly of claim 1, wherein a) said angular portion of the profile unit extends below the lower limit of said vertical portion, and is coextensive with the length thereof, to hide from view the point of connection adjacent profile units.

3. The merchandise display assembly of claim 1, wherein a) said angular portion further includes a foot extending outwardly at an angle from the lower edge of said main supporting part for retaining the merchandise in engagement with said main supporting part.

4. The merchandise display assembly of claim 3, wherein a) said upwardly extending flange is substantially vertical, the terminal thereof being beveled and in supporting engagement with the upper end of the main supporting part of the angular portion of an adjacent profile unit.

5. The merchandise display assembly of claim 1, wherein a) said securing means is a fastener extending through said vertical portion of the profile into said vertical supporting member.

6. The merchandise display member of claim 5, wherein a) said fastener is a screw.

7. The merchandise display assembly of claim 1, wherein a) the main supporting part of said angular portions of each said profile units extends at approximately a 45 degree angle to said vertical portion.

8. A merchandise display for engagement with a vertical support member, said assembly including a) a plurality of like merchandise profile units of predetermined length adapted to be joined together vertically;

b) each of said profile units having a vertical wall portion in contiguous engagement with said vertical support member and an angular wall portion comprising a rectilinear main supporting part extending downwardly and outwardly from the vertical wall portion on which merchandise is placed for display;

c) said angular wall portion being coextensive with the length of said vertical wall portion, the lower limit of said angular wall portion extending to a point below the lower limit of said vertical wall portion to hide from view the point of connection between adjacent profiles;

d) a first means for engaging the upper edge of one of said profile units with the lower edge of another of said profile units; and, e) a second means for securing each of said profile units to said vertical support member.

9. The merchandise display assembly of claim 8, wherein a) said first means comprises a flange extending vertically from the upper edge of each vertical wall portion of said profile units and coextensive with the length thereof;

b) said flange lying in a vertical plane which is spaced from the vertical plane of said vertical wall portion, thereof forming an elongated longitudinal groove between said flange and said vertical support member, into which the lower edge of the vertical wall portion of an adjacent profile unit fits.

10. The merchandise display assembly of claim 9, wherein a. the width of said elongated longitudinal recess is substantially equal to the thickness of the lower edge of said vertical wall portion to provide a tight fit between adjacent profile units.

11. The merchandise display assembly of claim 9, wherein:

a) said angular wall portion is spaced from the lower edge of said vertical wall portion, thereby providing a vertical wall portion extension which is substantially the same height as said flange extending upwardly from the upper edge of said vertical wall portion.

12. The merchandise display assembly of claim 8, wherein:

a. said second means comprises a fastener located near the upper portion of said vertical wall portion, said fastener being hidden from view by the angular wall portion of a profile unit which is engaged with the upper end thereof.

13. The merchandise display assembly of claim 12, wherein:

a) said fastener comprises a screw which extends through the vertical wall portion of said profile into the vertical support member.

14. The merchandise display assembly of claim 8 wherein a) said angular wall portion further includes a foot extending outwardly at an angle from the lower edge of said rectilinear main supporting part for retaining the merchandise in engagement with said main supporting part.

15. The merchandise display assembly of claim 14 wherein a) said second means is a fastener extending through said vertical portion of the profile unit into said vertical support member.

16. The merchandise display assembly of claim 15 wherein a) said fastener is located near the upper portion of said vertical wall portion, said fastener being hidden from view by the main supporting part of said angular portion of a profile unit engaged with the upper end thereof.

17. The merchandise display assembly of claim 8 wherein a) the rectilinear main supporting part of said angular portion of each of said profile units extends at approximately a 45 degree angle to said vertical portion.

* * * * *